US010100592B2

(12) United States Patent
Wase

(10) Patent No.: US 10,100,592 B2
(45) Date of Patent: Oct. 16, 2018

(54) DEVICE FOR HANDLING DRILL STRING COMPONENTS WITH RESPECT TO A ROCK DRILL RIG AND A ROCK DRILL RIG

(71) Applicant: EPIROC ROCK DRILLS AKTIEBOLAG, Örebro (SE)

(72) Inventor: Lars Wase, Danderyd (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 144 days.

(21) Appl. No.: 14/897,068

(22) PCT Filed: Jun. 26, 2014

(86) PCT No.: PCT/SE2014/000092

§ 371 (c)(1),
(2) Date: Dec. 9, 2015

(87) PCT Pub. No.: WO2015/016757

PCT Pub. Date: Feb. 5, 2015

(65) Prior Publication Data

US 2016/0130891 A1 May 12, 2016

(30) Foreign Application Priority Data

Aug. 2, 2013 (SE) ..... 1350926

(51) Int. Cl.
*E21B 19/16* (2006.01)
*E21B 19/08* (2006.01)

(52) U.S. Cl.
CPC ..... *E21B 19/161* (2013.01); *E21B 19/08* (2013.01)

(58) Field of Classification Search
CPC ..... E21B 19/08; E21B 19/161
See application file for complete search history.

(56) References Cited

U.S. PATENT DOCUMENTS 1,442,230 A * 1/1923 Magie ..... E21B 19/08 173/83
3,711,047 A * 1/1973 O'Leary ..... E21B 19/08 173/193

(Continued)

FOREIGN PATENT DOCUMENTS

CL 201503600 A1 7/2016
CL 201503677 A1 7/2016

(Continued)

OTHER PUBLICATIONS

PCT/ISA/210—International Search Report—dated Nov. 11, 2014 (Issued in Application No. PCT/SE2014/000092).

(Continued)

*Primary Examiner* — James G Sayre
(74) *Attorney, Agent, or Firm* — Venable LLP; Jeffri A. Kaminski

(57) ABSTRACT

A device for handling drill string components with respect to a drill rig. A gripper is configured to grip a first drill string component to be threaded on to or off from a second drill string component being part of a drill string which is partly drilled into a rock formation. A handling unit includes the gripper is movable between a drill string position and a loading position wherein a drill string component can be brought into or taken out from the gripper. The handing unit includes auxiliary engagement unit configured to align the gripped first drill string component to essentially in line with an axial direction defined by the second drill string component. The gripper and the auxiliary engagement unit are adjustable for gripping drill string components of different dimensions with maintained alignment of gripped drill string components.

15 Claims, 3 Drawing Sheets

(56) References Cited

U.S. PATENT DOCUMENTS

| | | | | |
|---|---|---|---|---|
| 6,189,620 | B1 | 2/2001 | McDowell | |
| 6,634,443 | B1 | 10/2003 | Paech et al. | |
| 8,056,647 | B2 * | 11/2011 | Folin | E21B 19/08 173/38 |
| 9,605,498 | B2 * | 3/2017 | Yorga | E21B 19/14 |
| 9,657,538 | B2 * | 5/2017 | Yorga | E21B 19/161 |
| 2005/0161227 | A1 | 7/2005 | Hayes et al. | |
| 2006/0118335 | A1 * | 6/2006 | Belik | E21B 19/00 175/57 |
| 2011/0091304 | A1 | 4/2011 | Tetley et al. | |
| 2013/0302114 | A1 * | 11/2013 | Reddy | E21B 3/02 414/22.55 |
| 2015/0136420 | A1 * | 5/2015 | Tengliden | E21B 19/16 166/379 |

FOREIGN PATENT DOCUMENTS

| | | | |
|---|---|---|---|
| CN | 201347730 | Y | 11/2009 |
| CN | 202850873 | U | 4/2013 |
| EP | 1916379 | A1 | 4/2008 |
| GB | 2047306 | A | 11/1980 |
| GB | 2334270 | A | 8/1999 |
| WO | WO-2013/176618 | A1 | 11/2013 |

OTHER PUBLICATIONS

PCT/ISA/237—Written Opinion of the International Searching Authority—dated Nov. 11, 2014 (Issued in Application No. PCT/SE2014/000092).

Chilean Office Action dated Jan. 31, 2018 issued in corresponding Chilean Patent Application No. 201503676 (11 pages).

* cited by examiner

DEVICE FOR HANDLING DRILL STRING COMPONENTS WITH RESPECT TO A ROCK DRILL RIG AND A ROCK DRILL RIG

CROSS-REFERENCE TO RELATED APPLICATIONS

The application claims priority to Swedish patent application 1350926-0 filed 2 Aug. 2013 and is the national phase under 35 U.S.C. § 371 of PCT/SE2014/000092 filed 26 Jun. 2014.

FIELD OF THE INVENTION

The invention relates to a device for handling drill string components in respect of a drill rig, said device including gripping means for gripping a first drill string component to be threaded on to or off from a second drill string component being including in a drill string which is partly drilled into a rock formation. The invention also relates to a drill rig including such a device.

BACKGROUND OF THE INVENTION

Handling of drill string components in connection with joining of new components to a drill string and releasing of a drill string is to a great extent preformed manually today. Hereby a new drill string component to be joined with the drill string is placed in a drill string position, whereupon it is initially threaded manually and subsequently finally threaded by the rotator equipment of the drill rig. The reverse procedure is performed during the dismounting of the drill string into separate components during for example exchange of drill bit or completed drilling.

Core drilling for the purpose of exploration drilling is often preformed to great depths and with very long drill holes such as thousand of meters or more. Individual drill string components, here normally drill tubes, normally have a length of for example 3 meters. Since exchange of drill bit must be preformed relatively frequently, there is required an extensive handling of the drill string components in connection with taking out the drill string from the drill hole as well as during lowering, for the replacement of drill bits.

U.S. Pat. No. 6,634,443 B1 is an example of the background art. This document describes a handing device for drill string components, wherein drill string components to be joined to the drill string are transferred between a loading position and a drill string position.

SUMMARY OF THE INVENTION

The invention has as an aim to provide a device and a method according to the above which allow more secure and more efficient handling of drill string components in respect of a drill rig and also with more flexibility for different applications such that in particular the complete procedure during taking up and lowering of the drill string in the drill hole can be made less exposed to upcoming problematic situations whereby totally more effective drilling can be preformed.

This aim is obtained in respect of a device according to the above in that the handing unit includes auxiliary engagement means for engaging said second drill string component in the drill string positions, that the handing unit with said auxiliary engagement means is adapted for guiding and aligning said gripped first drill string component to essentially in line with an axial direction defined by said second drill string component, that said auxiliary engagement means and said gripping means are arranged on a common carrier, and that said gripping means as well as said auxiliary engagement means are adjustable for gripping drill string components of different dimensions with maintained alignment of gripped drill string components.

Hereby is achieved in an efficient way that a first drill string component being intended for joining is actually aligned with the uppermost drill string component of the drill string being in the drill hole, such that in practice, aligned screw joining can be obtained which results in that threading together in fact is performed as intended and that the sensitive threaded portions of the drill string components are not unnecessarily subjected to oblique loads and thereby damages. A well suited and efficient adaption to different dimensions of drill string components is obtained.

This is because it has been shown that in many operational cases, an angular deviation occurs between the said uppermost drill string component of the drill string being in the drill hole and for example the feed beam of the drill rig. This can be of such a magnitude that attempts to thread together with reference to the direction of the feed beam or any other direction in the rig fails. In the best case, the damage is such that thread joining can be accomplished any way, but also minor damages result in shortened working life for the drill string components and thereby unnecessary costs.

By the invention is thus provided, through the auxiliary engagement means, the possibility of aligning the gripped first drill string component in line with or at least essentially in line with an outermost region of the second drill string component being the uppermost drill string component of the drill string in the drill hole.

Since this alignment is ensured through the invention, threading together is facilitated and the above mentioned problems with damage to the drill string components are avoided as well as failing joining attempts.

Said auxiliary engagement means are, for achieving good effect, arranged to engage portion of the second drill string component positioned at an axial distance from each other or at least with at least a certain axial length. A variant of said auxiliary engagement means is suitably comprised of one single clamping means having clamping surfaces from the group: engagement elements such as clamping ridges positioned at a distance from each other as seen in an axial direction of a gripped drill string component, engagement elements that extend over a portion in axial direction of a gripped drill string component, such as jaws having a width, as seen in said axial direction, in general corresponding to at least a diameter of a drill string component.

Said auxiliary engagement means and said gripping means are suitably arranged on a common carrier, which highly facilitates alignment. This carrier contributes together with said auxiliary engagement means and said gripping means in varying angle and alignment.

Preferably said gripping means as well as said auxiliary engagement means are displaceable relative to a swing axis for adjustment purposes. The movability is suitably in a direction/directions deviating from a direction extending radially in respect of the swing axis. Preferably said gripping means and said auxiliary engagement means are displaceably and fixedly supported by said carrier. The fixability is suitably with the aid of holes coming in alignment with each other in adequate resetting and locking elements which are then introduced into these aligned holes. The gripping space is further suitably adjustable for said gripping means as well as for said auxiliary engagement means with maintained alignment of gripped drill string components.

Preferably each gripping means includes a driveable rotation wheel for thread rotation of a gripped drill string component and freely rotational rotation rollers, wherein at least one rotation roller is adjustable in respect of the rotation wheel.

Suitably said auxiliary engagement means includes a fixed and a movable jaw. In particular said fixed jaw comprises a recess of V-shape with the recess directed in a swing direction of said auxiliary engagement means for gripping a drill string component.

Preferably the carrier is pivotal around the swing axis which is essentially parallel to an axial direction of a gripped drill string component.

Said auxiliary engagement means is suitably comprised of a clamping means with clamping surfaces from the group: engagement elements positioned at a distant from each other as seen in an axial direction of a gripped drill string component, engagement elements extending over a portion in axial direction of a gripped drill string component.

It is preferred that said means for variation of angle includes joint means with a play or flex between parts thereof. Said joint means are suitably formed with a play or flex in radial direction and/or with a yieldingness in rotational direction between its parts. It is also preferred that said play or flex and yieldingness between its parts is adapted to be against the action of an elastic element or elements. Said means for variation of angle includes preferably a divided support arm being positioned between said support means and said gripping means and including at least one elastic element between parts of the support arm.

It is highly preferred that said gripping means are arranged to subject a gripped first drill string component to an axial movement in connection with threading it together with or apart from a second drill string component. Said support means preferably includes a body for fastening to the rig, said body supporting a rotational actuator in the form of swing motor for swinging the handling unit between the drill string position and the loading position.

Said gripping means are arranged to subject a gripped first drill string component to an axial movement in connection with threading it together with or apart from a second drill string component such as the rotation is related to the axial movement in order to adapt to the pitch of the present thread.

It is within the scope of the invention, that the support means includes a slide beam being arranged essentially in parallel with a feed beam of the drill rig, and whereon a slide is drivable to and fro, wherein the handling unit is connected to this slide. This gives the possibility of setting the loading position to prevailing situation and requirement. Preferably the handling unit is movably connected to said slide over an angel adjustment arrangement including a rotation motor with a rotational axis being positioned in a plane perpendicular to a longitudinal axis of the slide beam, for swinging the handling unit with a gripped drill string component between a position in parallel with the drill string position and a horizontal loading position. Hereby loading is facilitated and in particular automatic loading is simplified, whereby a magazine having horizontally positioned drill string components is connected to a drill rig according to the invention. It is to be understood that there can also be vertical and slanting loading positions for the device according to the invention.

It is preferred that the handling unit is displaceable so as in the drill string position to engage an inner tube for the reception of a core sample. This is achieved by the handling unit being displaceable such that said auxiliary engagement means in the drill string position will end up axially above a drill string component being fixed in this position in order instead to be capable of engaging said inner tube when it is pulled out from the fixed drill string component. Handling the inner tube can after complete extraction be performed as in the corresponding handling of different types of drill string components.

A rock drill rig according to the invention includes an inventive handling device. This rock drill rig is suitably constructed for core drilling but can also be constructed for other types of drilling.

BRIEF DESCRIPTION OF DRAWINGS

The invention will now be described in greater detail at the background of embodiments and with reference to the annexed drawings, wherein.

DESCRIPTION OF EMBODIMENTS

Figure 1:
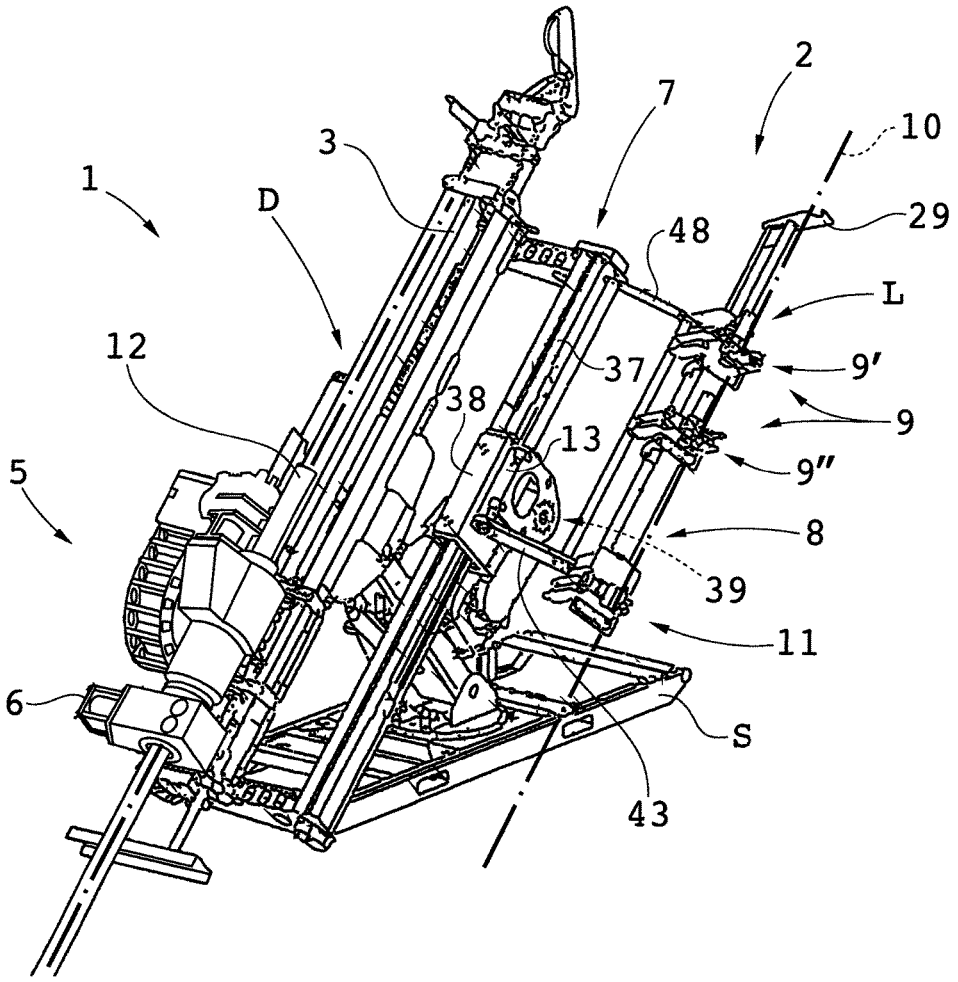
FIG. 1 shows a drill rig equipped with a device according to the invention.

FIG. 1 shows a drill rig 1 for core drilling being supported by a support structure S, said drill rig as usual being equipped with a feed beam 3, a carriage 5 being drivable back and forth and having a rotator for driving and rotating a drill string with an upper second drill string component 12 and a lower drill string holder 6.

A support means 7 comprises a body for fastening a device 2 for handling drill string components (named handling device) on the rig. Connecting beams are arranged for fastening the support means 7 in the regions of the upper and lower ends of the feed beam 3.

The support means 7 in the shown example includes a body, whereon a swing device is arranged, which in turn includes a swing motor 13. The body being the support means is arranged sideways of and (with a central axis) in parallel to the feed beam.

The handling device 2 includes gripping means (globally indicated with 9) for gripping a first drill string component (indicated with interrupted line at 10) to be put into a drill string position D in the rig or to be taken out from the rig for subsequent positioning in a magazine.

Reference numeral 29 relates to a support which is rigidly applied at an upper region of the support means 7 for support and for assistance during positioning of the first drill string component 10 in the position shown in FIG. 1, which is named loading position L.

The handling device 2 also includes auxiliary engagement means 11 being arranged to engage with a second drill string component 12, in an outermost part thereof, being uppermost in the drill string being drilled into the rock in the drill string position D and somewhat protruding from the rotator in a manner which will be explained below.

In a second position, the first drill string component 10 is in the drill string position D, that is in a position where the first drill string component 10 as well as the second drill string component 12 being uppermost in the drill string is in the drill string position D. In this position, the auxiliary engagement means now engages the second drill string component 12.

During activation of the auxiliary engagement means 11 there is actively obtained an alignment of a longitudinal holder for a handling unit 8, which includes said holder and said auxiliary engagement means 11 as well as the gripping means 9, in this embodiment including two gripping means 9' and 9" being positioned at a distance from each other as seen in an axial direction of a gripped drill string component. Since the gripping means 9' and 9" are still in engagement with the first drill string component 10 mutual alignment of the drill string components 10 and 12 is hereby initiated.

For that purpose, there exists in the handling device 2 a resilience of a portion which is between the holder of the handling unit 8 which carries and directly co-operates with the gripping means and the auxiliary engagement means, and said support means 7.

Activating the auxiliary engagement means 11 will thereby provide an appropriate alignment of the first drill string component 10 with the second drill string component 12 for a subsequent threading operation.

In the aspect of the invention shown in FIG. 1, the support means 7 includes a slide beam 37, arranged essentially in parallel to a feed beam 3 belonging to the drill rig, whereon a slide 38 is movable to and fro, wherein the handling unit is connected to said slide. This gives the possibility of adjusting the loading position to prevailing situation and requirements. The handling unit 8 is movably connected to said slide over a pivoting arrangement which includes a rotation motor having a swing axis extending in a plane at a right angle to a longitudinal axis of the slide beam 37 for swinging the handling unit 8 with a gripped drill string component between a position in parallel to the drill string position and a horizontal loading position (not shown). Hereby loading is facilitated and in particular automatic loading is simplified, wherein a (not shown) magazine having horizontally positioned drill string components is connected to a drill rig according to the invention. The swing motor 39 can be oriented differently in relation to the slide than what is shown in FIG. 1 with maintaining the swing axis extending in a plane at a right angle to the longitudinal axis of the slide beam 37.

Figure 2:
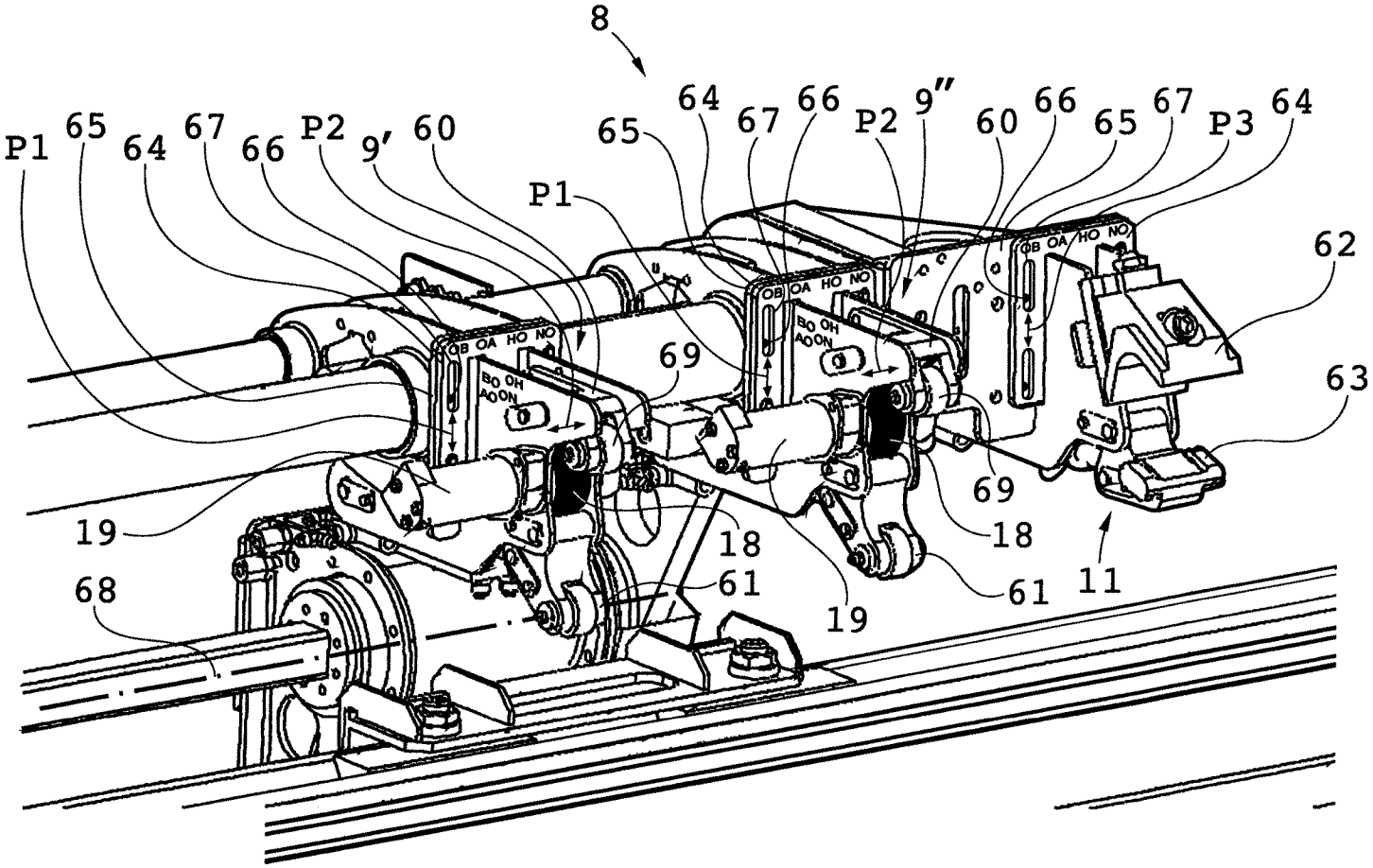
FIG. 2 shows a detail of the device according to the invention in greater scale, and FIGS. 3*a* and *b* show diagrams for the illustration of the adjustment according to the invention.

FIG. 2 shows the area of the gripping means 9' and 9" and the auxiliary engagement means 11 in greater detail. It is apparent that each gripping means 9' and 9" include a rigid jaw and a movable jaw which is maneuverable for opening and closing with the aid of a respective hydraulic cylinder. Outermost on each jaw there are rotation rollers and inside each gripping means there is also a rotation wheel 18, which are rotationally driven by way of a respective rotation motor 19.

In closed position of the first jaw of each gripping means 9' and 9" a first drill string component lies in three points against respective gripping means, viz. against the rotation rollers outermost on the jaws and against the rotation wheel. This results in that the drill string component 10 (see FIG. 1) can be rotated by initiating the rotation motors 19 for the purpose of thread joining and separating the first drill string component 10 in respect of the second drill string component 12.

Further, the gripping means 9' and 9" are carried axially movable in respect of the auxiliary engagement means 11.

Means for variation of an angle are supported by arms 43 and 48 arranged between the slide 38 and the handling unit 11.

Also the auxiliary engagement means 11 includes a rigid jaw 62 and a movable jaw 63, wherein the movable jaw is maneuverable by way of a hydraulic cylinder. The auxiliary engagement means does not include any rotation roller as a contrast to the gripping means.

Between the auxiliary engagement means 11 and the gripping means 9' and 9" and said support means 7 (FIG. 1) are positioned resilient yielding hubs, here named flex hubs.

The flex hubs allow radial flex in respect of a body of the hub, allowing angular deviation between a holder shaft for the gripping means the auxiliary engagement means and the support means 7 and thereby the feed beam 3 of the rig.

Besides a radial yieldingness, the flex hubs also allow a rotational yield, which is against action of spring means.

According to the invention, said gripping means 9 as well as said auxiliary engagement means 11 are adjustable for gripping drill string components of different diameters or thickness with maintained alignment of gripped drill string components. This is accomplished by said gripping means 9 as well as said auxiliary engagement means 11 being displaceable relative to the swing axis 68 for adjustment purposes. The ability to move is preferably in a direction/directions deviating from a direction extending radially in respect of the swing axis 68 in order to provide a more easily adjusted construction. In particular, said gripping means 9 and said auxiliary engagement 11 are displaceably and fixably supported by said carrier as is shown in FIG. 2. Each gripping means 9' and 9" is arranged as a gripper unit on a support plate 64, which is displaceably and fixably arranged on a plate being rigidity supported by the carrier 65.

At the upper regions of the plates 64, there are shown index holes marked B, A, H and N which indicate different dimensions of drill string components to be gripped. These holes comprise fixing holes for the gripping means and upon displacement of the plates 64 of the gripping means 9' and 9" in respect of the carrier plate 65 according to the double arrows P1, in different positions different index holes will come into an alignment with (not shown) fixed index holes in the respective carrier plate 65. When a desired alignment has been obtained, the desired position is fixed through inserting a locking pin, screw or the like in the aligned holes. Thereupon the plate 64 is finally fixed with its gripping means through a not shown screw fastener which is introduced into the hole 66 which is always available because of the oblong hole 67 in the plate 64.

Furthermore, the adjustable jaw 60 is adjustable by being displaceable according to the double arrow P2 in respect of (more or less close to) the rotation wheel 18. Fixing is achieved in a corresponding way as is described above with index holes and locking pins (or the like). Through adjustment of two points in the gripping means, a position of a gripped drill string component is established. The movable jaw 61 is capable of lying against a gripped drill string component through stroke variation and therefore does not have to be adjusted for adaption to different requirements of grip spaces.

Adjustment of the auxiliary engagement means 11 is partly accomplished in a corresponding manner to what is described above. Also in this case there is thus on a fixed carrier plate 65 a displaceable (here according to the double arrow P3) support plate 64, which is handled in a manner as described above as concerns index holes and locking pins or the like. Fixation is accomplished in a corresponding way for example through a screw in a hole 66 through an oblong hole 67. The degree of displacement and the direction of displacement of the auxiliary engagement means 11 do not have to be identical to the ones of the gripping means. The fixed jaw 62 is in this case a block having a V-shaped recess directed in a swinging direction of the auxiliary engagement means 11 when a drill string component is to be gripped. The fixed jaw 62 can require replacement for adaption to different dimensions but it is not excluded that the same fixed jaw can be used for at least some requirements of gripping spaces for different dimensions.

Figure 3B:
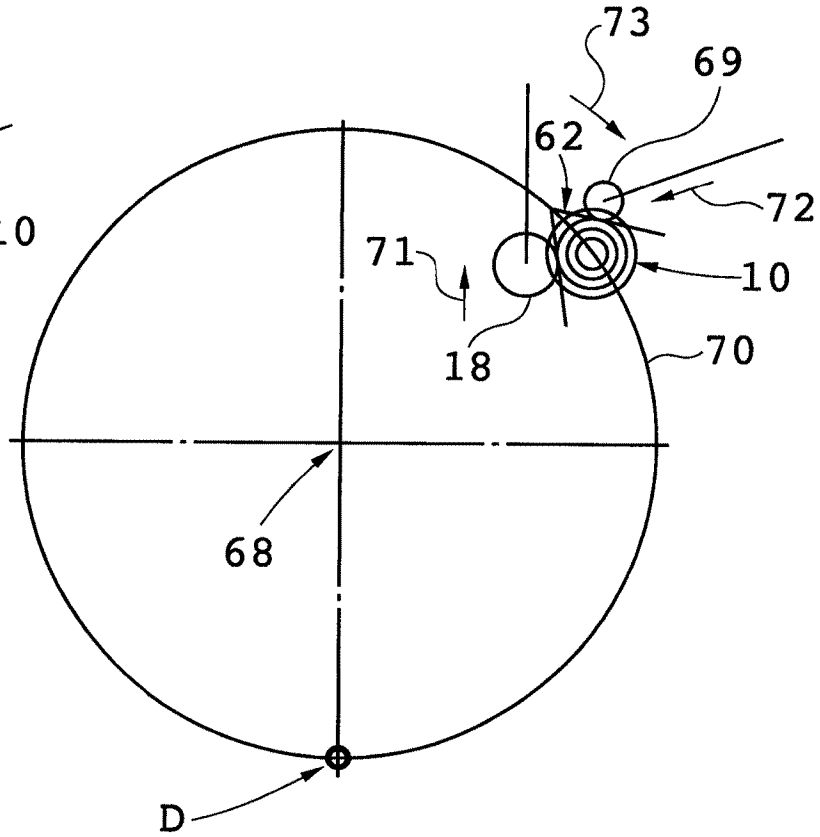
Figure 3A:
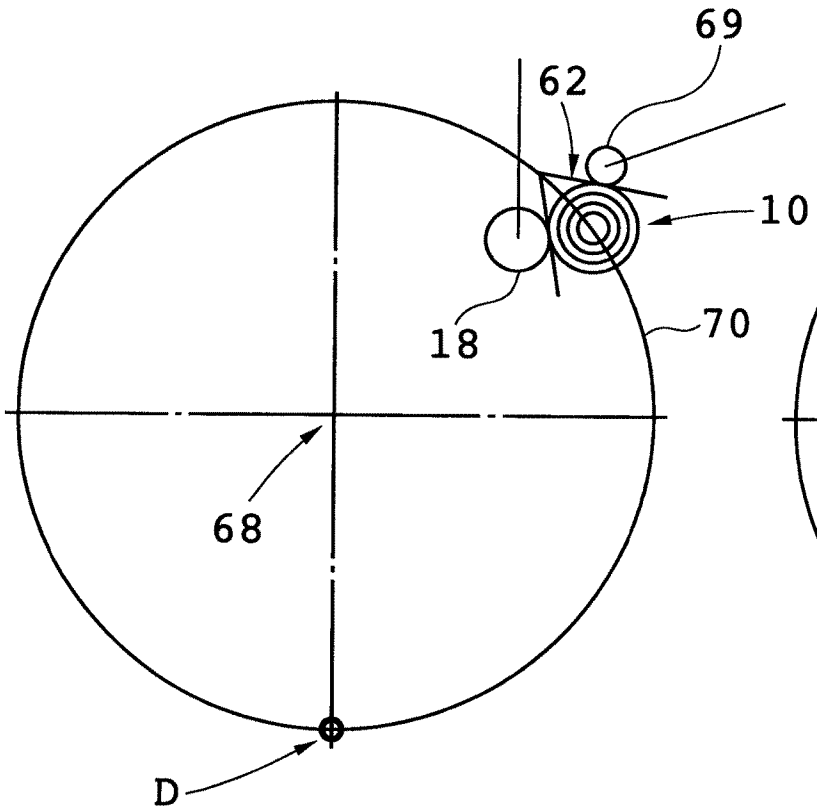

FIGS. 3*a* and *b* show diagrammatically the adjustment according to the invention in connection with different dimensions for drill string components 10 to be gripped. In order for gripped drill string components 10 of different dimensions to be placed in the drill string position D in the rig, the gripping means and the auxiliary engagement means have to be adjusted such that a centre of the gripped drill string component is on the swing path 70 irrespective which one of the intended four dimensions of the drill string component 10 on FIGS. 3*a* and *b*. Further, a drill string component being gripped by the gripping means shall be coaxial to a drill string component being gripped by the auxiliary engagement means. FIGS. 3*a* and *b* illustrate this in that the rotation wheel 18 and the rotation roller 69 intended for fixed mounting are brought to come closer to each other for smaller dimensions of drill string components by this placement according to the respective arrows 71 and 72. Furthermore, a mutual displacement of the grip spaces of the gripping means respectively the auxiliary engagement means to obtain that gripped components are coaxial. This is obtained through the adjustability being explained in connection with FIG. 2. 73 indicates a swing direction of the device.

The invention can be modified within the scope of the following claims. The adjustability can thus be arranged otherwise. The plate 64 and carrier plate 65 can be replaced by other supports or supporting structures. The index holes can be replaced with recesses, notches or the like in one of the parts that come into engagement with some kind of fixed protrusion in the other one of the parts.

The invention has been described at the background of core drilling with drill string components being comprised of drill pipes, but it shall be noted that the invention finds use also in respect of other kinds of drilling where a drill string is comprised of drill string components that are threaded together. Also different types of drill string components of different dimensions included in a drill string, such as lifting plugs and other elements can be handled by the inventive device. Through the invention, it is achieved that in an efficient way also components with deviating dimensions used in a specific drill string such as inner tube or catch pipe for a free drilled core, to be collected from the drill string can be handled because of the adjustability according to the invention.

The invention claimed is:

1. A device for handling drill string components with respect to a drill rig, said device comprising:

a gripper configured to grip a first drill string component to be threaded on to or off from a second drill string component being part of a drill string which is partly drilled into a rock formation, a support configured to fasten the device for handling drill string components onto the drill rig, and a handling unit which is movably connected to said support, which includes said gripper, and which is movable between a drill string position, in which a gripped first drill string component is positioned for threading on to and off from said second drill string component and a loading position wherein a drill string component can be brought into or taken out from said gripper, wherein the handing unit includes an auxiliary engagement unit configured to engage said second drill string component in the drill string positions, wherein the handing unit with said auxiliary engagement unit is adapted for guiding and aligning said gripped first drill string component to be essentially in line with an axial direction defined by said second drill string component, wherein said auxiliary engagement unit and said gripper are arranged on a common carrier, wherein said gripper and said auxiliary engagement unit are adjustable for gripping drill string components of different dimensions with maintained alignment of gripped drill string components, wherein said auxiliary engagement unit includes a fixed and a movable jaw, and wherein said fixed jaw comprises a recess of V-shape with a recess directed in a swing direction of said auxiliary engagement unit for gripping a drill string component.

2. The device according to claim 1, wherein said gripper and said auxiliary engagement unit are displaceable relative to a swing axis for adjustment purposes.

3. The device according to claim 1, wherein said gripper and said auxiliary engagement unit are displaceably and fixedly supported by said carrier.

4. The device according to claim 1, wherein grip spaces for said gripper and for said auxiliary engagement unit are adjustable with maintained alignment of gripped drill string components.

5. The device according to claim 4, wherein each gripper includes a driveable rotation wheel for thread rotation of a gripped drill string component and freely rotational rotation rollers, wherein at least one rotation roller is adjustable in respect of the rotation wheel.

6. The device according to claim 1, wherein the carrier is pivotal around the swing axis which is essentially parallel to an axial direction of a gripped drill string component.

7. The device according to claim 1, wherein said auxiliary engagement unit comprises a clamper with clamping surfaces selected from the group comprising: engagement elements positioned at a distant from each other as seen in an axial direction of a gripped drill string component or engagement elements extending over a portion in axial direction of a gripped drill string component.

8. The device according to claim 1, wherein the handling unit includes an adjustment unit configured to vary an angle of said gripper and thereby said gripped first drill string component with respect to said support in order to allow said alignment in the drill string position.

9. The device according to claim 8, adjustment unit configured to vary an angle includes a joint with play or flex between parts thereof.

10. The device according to claim 9, wherein said joint includes at least one of a play of flex in radial direction or a yieldingness in rotational direction between its parts.

11. The device according to claim 10, wherein said play or flex and yieldingness between its parts is adapted to be against the action of an elastic element or elements.

12. The device according to claim 8, wherein the adjustment unit configured to vary angle includes a divided support arm being positioned between said support and said gripper and including at least one elastic element between parts of the support arm.

13. The device according to claim 1, wherein said gripper is arranged to subject a gripped first drill string component to an axial movement in connection with threading the gripped first drill string component with or apart from a second drill string component.

14. The device according to claim 1, wherein the handling unit is displaceable in order in the drill string position (D) to engage with an inner tube for extracting a core sample.

15. A rock drill rig, comprising:

a device for handling drill string components with respect to a drill rig, said device comprising a gripper configured to grip a first drill string component to be threaded on to or off from a second drill string component being part of a drill string which is partly drilled into a rock formation, a support configured to fasten the device for handling drill string components onto the drill rig, and a handling unit which is movably connected to said support, which includes said gripper, and which is movable between a drill string position, in which a gripped first drill string component is positioned for threading on to and off from said second drill string component and a loading position wherein a drill string component can be brought into or taken out from said gripper, wherein the handing unit includes an auxiliary engagement unit configured to engage said second drill string component in the drill string positions, wherein the handing unit with said auxiliary engagement unit is adapted for guiding and aligning said gripped first drill string component to be essentially in line with an axial direction defined by said second drill string component, wherein said auxiliary engagement unit and said gripper are arranged on a common carrier, wherein said gripper and said auxiliary engagement unit are adjustable for gripping drill string components of different dimensions with maintained alignment of gripped drill string components, wherein said auxiliary engagement unit includes a fixed and a movable jaw, and wherein said fixed jaw comprises a recess of V-shape with a recess directed in a swing direction of said auxiliary engagement unit for gripping a drill string component.

* * * * *